United States Patent [19]

Delessard et al.

[11] 4,338,160

[45] Jul. 6, 1982

[54] PROCESS FOR DRYING AND/OR PREHEATING COAL

[75] Inventors: Serge Delessard, Forbach; Roger M. Puff, Freyming-Merlebach, both of France

[73] Assignee: Charbonnages de France, Paris, France

[21] Appl. No.: 173,893

[22] Filed: Jul. 28, 1980

[30] Foreign Application Priority Data

Jul. 30, 1979 [FR] France ..... 79 19531

[51] Int. Cl.[3] ..... C10B 39/02; C10B 45/00; C10B 57/10

[52] U.S. Cl. ..... 201/1; 34/10; 201/39; 201/41; 202/150; 202/228; 432/15; 432/17

[58] Field of Search ..... 201/1, 39, 41; 202/150, 202/228; 432/13, 14, 15–17, 58; 34/9, 10, 13

[56] References Cited

U.S. PATENT DOCUMENTS

| | | | |
|---|---|---|---|
| 1,854,407 | 4/1932 | Janeway, Jr. . | |
| 3,007,254 | 11/1961 | Schuster | 34/13 |
| 3,728,230 | 4/1973 | Kemmetmueller | 201/39 |
| 3,793,743 | 2/1974 | Kemmetmueller | 202/150 X |
| 3,843,458 | 10/1974 | Kemmetmueller | 201/39 |
| 4,053,364 | 10/1977 | Poersch et al. | 201/13 |
| 4,102,635 | 7/1978 | Beck | 432/14 |
| 4,174,947 | 11/1979 | Delessard et al. | 432/15 |

FOREIGN PATENT DOCUMENTS

| | | |
|---|---|---|
| 453464 | 4/1924 | Fed. Rep. of Germany . |
| 2173997 | 10/1973 | France . |
| 2225503 | 11/1974 | France . |
| 2265840 | 10/1975 | France . |
| 2378081 | 8/1978 | France . |

*Primary Examiner*—Bradley Garris

*Attorney, Agent, or Firm*—Cushman, Darby & Cushman

[57] ABSTRACT

A plant for pre-heating by fluidizing and for milling coking coal in a treatment chamber is combined, by means of heat a exchanger interposed in a circuit for recirculating heat-conveying gas, with a plant for the dry quenching of hot coke in a quenching chamber. The flow, through the heat exchanger, of recycled quenching fumes of the coke is regulated in dependence on the rate at which the coal is introduced into the treatment chamber by a screw conveyor. An auxiliary heat combustion chamber permits precise control of the temperature in the treatment chamber.

4 Claims, 1 Drawing Figure

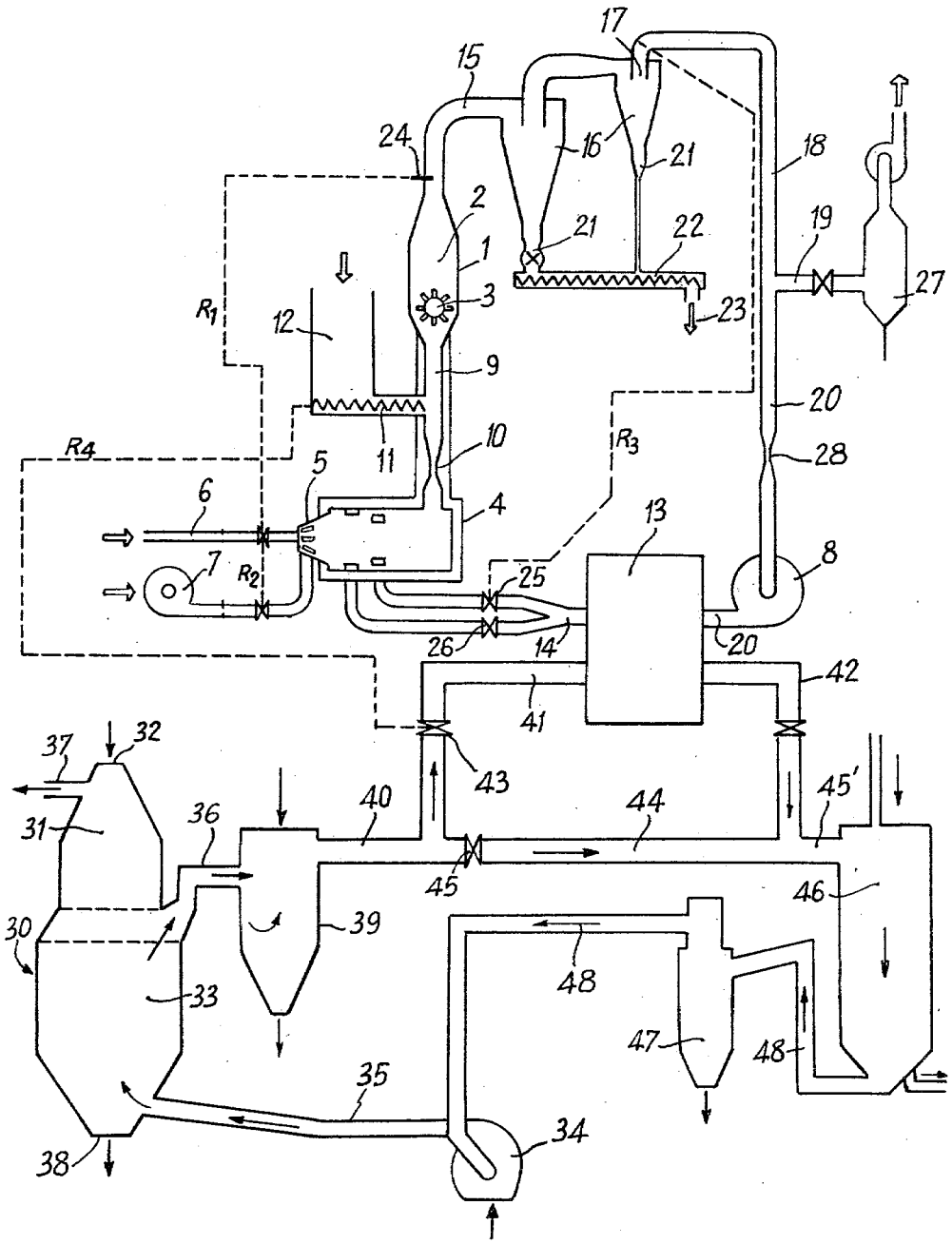
17
15
24
16
21
18
2
21
22
19
1
27
3
23
R1
12
9
20
R4
11
10
R3
28
5
6
4
13
7
R2
25
8
26
14
20
42
41
37
32
43
31
36
40
44
45'
45
46
30
39
48
33
47
48
35
34
38

PROCESS FOR DRYING AND/OR PREHEATING COAL

BACKGROUND OF THE INVENTION

The present invention relates to a process for at least one of drying and pre-heating, by at least one of entraining and fluidising, coal to be coked by means of one of a neutral and reducing heat-conveying gas which is partially recycled and maintained at temperature of substantially 250° to 650° C., in which process coal is introduced into one of a drying and pre-heating chamber by means of a device for introducing the coal at at least one of a known and controllable rate. The present invention also relates to a plant for carrying out the process.

Almost all metallurgical coke is manufactured in conventional coke ovens in which the charge is raised to a temperature of approximately 1,000° C. On being discharged from the coke oven, the coke is generally cooled by extensive water spraying in a quenching tower. The sensible heat thus lost from the coke represents 40 to 45% of the heat employed to heat the coke furnaces, which is 550 to 600 therms per ton of dry coal charge. This is the most important item of heat losses in the heat balance of the coking process. Recovery of the sensible heat of coke by means of quenching using a dry method has been considered for a long time, the principle of this method being as follows. The hot coke is cooled by direct contact with inert gases circulating in a closed cycle. The sensible heat recovered by the gases is used to produce steam.

However, dry quenching processes have in general been critised for producing steam which is not usually utilised. The use of this heat in the actual coking plant would obviously be far preferable to installing turbines for generating electricity. The pre-heating of coal could be another application, as already described in German Pat. No. 453,464, and more recently in French Pat. No. 2,173,997 and its equivalents, German Pat. No. 2,304,541 and U.S. Pat. Nos. 3,843,458 and 3,728,230, which propose, for drying the coal, the use of a gas which is heated in a heat exchanger by quenching gas, when the latter has already supplied some of its heat to a steam generator.

In German Pat. No. 453,464, the heat exchange is incomplete. In the other aforementioned process, an attempt has been made to isolate the two quenching and heat-conveying gas circuits with a number of complex gas-gas and gas-liquid exchangers, by providing the heat to the coal in two separate drying and heating stages and by introducing steam condensers. However, if the already dried coal is brought into contact with gases at a temperature of more than 350° C., the coal will then be adversely affected.

An object of the present invention is to avoid these disadvantages and to provide a new process and a plant for carrying out the process, which allow the temperature of the heat-conveying gas to be properly regulated and the sensible heat of the dry-quenching fumes of the coke to be properly utilised, while avoiding the introduction, into the quenching fumes, of steam which is likely to gasify the coke. A further object of the present invention is to ensure that in all circumstances heat is provided in the necessary quantity to the heat-conveying gas, that is to say to the coal to be dried and/or pre-heated, whilst making it possible to use the heat which is in excess in relation to that necessary, particularly if the latter is a small quantity or non-existent as a result of voluntary or accidental stoppage of the dryer and/or pre-heater. A further object is, again, to enable the two quenching and drying and/or pre-heating plants to be separated at any time to prevent breakdowns affecting one plant from affecting the other.

SUMMARY OF THE INVENTION

According to the present invention there is provided a process for at least one of drying and pre-heating coking coal, comprising:

(a) introducing coking coal into a treatment chamber at a known and/or controllable rate;

(b) introducing into the treatment chamber a heat-conveying gas at a temperature of substantially 250° C. to 650° C., which gas is selected from the group consisting of neutral and reducing heat-conveying gases;

(c) entraining and fluidising the coal in the chamber by means of said gas;

(d) collecting gas from the treatment chamber and introducing that gas into a heat exchanger;

(e) introducing into the heat exchanger hot dry-quenching fumes produced by dry quenching of hot discharged coke;

(f) transferring heat in the heat exchanger from the hot dry-quenching fumes to the heat-conveying gas; and (g) recycling the heat-conveying gas to the treatment chamber.

It is advantageous for the rate of flow of quenching fumes introduced into the heat exchanger to be controlled by the input of the device for introducing the coal, to be dried and/or pre-heated, into the drying and/or pre-heating chamber.

The portion of the quenching fumes used for heating the heat-conveying gas and the unused portion may be used to generate heat by heat exchange, and some of the heat necessary for drying and/or pre-heating the coal may be provided by a combustion chamber, the heat input of which is controlled by the temperature sensed in the drying and/or pre-heating chamber.

By the above, very simple means, the fitting of complicated equipment is avoided and water condensation problems are overcome, for it is not inconvenient if ultimately the heat-conveying medium is only steam, whereas it would be detrimental if it were the recycled quenching fumes which contained steam.

Also according to the present invention there is provided a plant for at least one of drying and pre-heating coal combined, with a plant for dry-quenching of hot discharged coke, comprising;

(a) means defining a treatment chamber for at least one of drying and pre-heating coal by at least one of entraining and fluidising the coal;

(b) means for introducing into the treatment chamber a heat-conveying gas at a substantially constant flow rate for at least one of entraining and fluidising the coal;

(c) means of recycling at least some of the heat-conveying gas;

(d) a device for introducing coal into the treatment chamber at least one of a known and controllable rate; p1 (e) means defining a further chamber for dry-quenching coke;

(f) a circuit connected to the further chamber, for utilising heat of and for recycling coke quenching fumes from the further chamber;
(g) a heat exchanger for heating the heat-conveying gas by quenching fumes received directly from the further chamber;
(h) an inlet pipe system for conveying the quenching fumes to the heat exchanger; and
(i) an outlet pipe system leading from the heat exchanger.

Pipe systems for admitting and discharging the fumes from the heat exchanger may be connected by a by-pass line, valves being provided to regulate the distribution of the rate of flow of the quenching fumes in two portions between the exchanger and the by-pass line and means being provided to control the flow of the portion of quenching fumes passing through the exchanger in accordance with the flow rate of the device for introducing the coal into the chamber.

A pipe system may connect the pipe system for discharging the fumes from the exchanger and the by-pass line, to convey the fumes to another heat utilisation plant, and the means of introducing the heat-conveying gas into the drying and/or pre-heating chamber may communicate with a combustion chamber which may be interposed between the pipe system for discharging the heat-conveying gas from the exchanger and the means for introducing the heat-conveying gas into the drying and/or pre-heating chamber.

If the drying and/or pre-heating chamber is provided with temperature sensing means, it is advantageous for the combustion chamber to be provided with heat input-regulating means which are controlled by the temperature sensing means in the drying and/or pre-heating chamber, or at the outlet thereof.

BRIEF DESCRIPTION OF THE DRAWINGS

An embodiment of the present invention will now be described, by way of example and with reference to the accompanying drawing, the single FIGURE of which shows a plant for drying and/or pre-heating coal.

DESCRIPTION OF THE PREFERRED EMBODIMENT

A plant for the preliminary treatment of coal to be coked comprises a combined mill and pre-heater 1 for crushing and pre-heating in a fluidised bed. This combined mill and pre-heater 1 comprises a treatment chamber which is a fluidisation chamber 2 inside which a hammer mill 3 rotates. The fluidising and heating gas for the fluidising and pre-heating of the coal is produced partly in a combustion chamber 4 by the combustion of a gas, which is conveyed to a burner 5 of the combustion chamber through a pipe system 6, with air driven by a fan 7. In addition, the fumes from the preliminary treatment of the coal are recirculated, via a heat exchanger 13 and a duct 14, into the combustion chamber by a fan 8. The heat exchanger 13 is of a type in which heat exchange takes place through a separating wall, for example tubes or a coil, avoiding any communication between the two gas circuits which are to exchange heat. The hot gases coming from the heat exchanger 13 and from the combustion chamber 4 are conveyed, through a venturi 10, to a vertical pipe system 9 for pneumatic conveying and pre-drying, into which pipe system coal, stored in a hopper 12, runs from a screw conveyor 11. The vertical pipe system 9 leads into the fluidising, crushing and pre-heating chamber 2. Leading from the top of the chamber 2 is a pipe 15 for pneumatically conveying the milled and pre-heated coal by means of the fluidising gas which acts once more as a conveying gas medium. The pipe 15 brings the gas medium and the conveyed coal to a series of cyclones 16, to the vortex 17 of the last of which or of the latter group of which is connected a pipe system 18 serving to collect the gases which are then distributed between a blow-off pipe 19 and a circulating pipe 20, which has a flow metering constriction 28 and is connected to the fan 8. At the tapered ends 21 of the cyclones 16, the pre-heated coal is collected, ready for charging into a coke oven, and for this reason it is conveyed by a conveying unit 22 to a hot coal hopper 23.

There is provided a plant for the dry quenching of the hot discharged coke, the principal apparatus of which plant is a dry-quenching chamber 30, which comprises an ante-chamber 31 which forms a screen for introducing the coke to be quenched, which coke is introduced through an opening 32. From the ante-chamber 31 the coke moves down into the cooling chamber 33 which serves as a heat exchanger between the hot solid coke and neutral or reducing gas fumes which are conveyed to the cooling chamber 33 by a fan 34 and a pipe system 35 and which are evacuated, through a pipe system 36, for the utilisation of their sensible heat. The gases and the vapour which are released into the ante-chamber 31 by the coke are extracted by a blow-off pipe 37. The cooled coke is extracted at 38. The neutral or reducing gas fumes are used in a closed circuit from the pipe system 36 to the fan 34. At the outlet of a dust separator 39, a pipe system 40 conducts these fumes to the exchanger 13 through a pipe system 41, 42, the flow rate of which is controlled by a valve 43 or a set of valves. Upstream from the valve 43, the pipe system 41, 42 is connected by a by-pass line 44 which forms a circuit and which can comprise a valve 45 cooperating with the valve 43 to regulate the distribution of the flow of hot fumes between the exchanger 13 and the line 44. At their junction, the lines 42 and 44 lead into a branch pipe 45' connected to a boiler 46, at the outlet of which the quenching fumes, which are now cold, are conveyed back to the fan 34 via a deduster 47 and the line 48. It is possible to see the considerable simplicity of the combined plant, the elimination of any risk of the two basic plants disrupting one another, and the simplicity of the dis-connection of the two plants by the simple closure of the valve 43.

The plant also comprises regulating devices.

It comprises a regulating circuit R2 which ensures stoichiometric combustion in the burner 5.

The plant also has a circuit R1 for regulating the gas flow to the pipe 6 so that the supplementary heat input is subject to the temperature recorded in the chamber 2, or at the outlet thereof, by a temperature probe 24. The flow of recycled heat-conveying gas is regulated at the outlet of the exchanger 13 by valves 25 and/or 26 which are controlled by the pressure at the vortex 17 by means of a regulating circuit $R_3$.

Finally, and in accordance with a preferred feature of the invention, the distribution of the flow of hot quenching fumes between the exchanger 13 and the by-pass 44 is ensured by the valve 43, the regulatable flow control of which is controlled, by means of a regulating circuit $R_4$, by the rate of delivery of coal to the dryer and/or pre-heater 1 from the screw conveyor 11.

In the case of a unit 30 for quenching 56 tons per hour of coke cooled from 1,000° C. to 220° C., the quantity of steam generated is 26.1 tons per hour having the following characteristics: 440° C., 40 kg/cm$^2$. The quantity of heat recovered is of the order of 325 therms per ton of coke, or 240 therms per ton of dry coal. In the case of a pre-heating unit operating at 200° C., it is estimated that 210 to 240 therms per ton coke are required. At 260° C., approximately 300 therms per ton of coke are required. The heat balance is therefore favourable in the process according to the invention. In the case of a dry-quenching unit having an output of 56 tons per hour, the gas flow rate is 90,000 m$^3$ N/h at a temperature of 750° to 800° C. It will therefore be possible for a quenching plant having an output of 56 tons per hour of coke to be combined with a unit which pre-heats 80 tons per hour of wet coal.

In the plant described, it will be possible to adopt a temperature of 260° C. as the reference temperature at the temperature probe 24.

The pre-heating temperature will therefore be maintained at 260° C. with high precision, by the automatic control of the gas flow to the burner 5 of the combustion chamber 4. Consequently, the regulating circuit $R_2$ will adjust the air flow in order that combustion may remain stoichiometric. The flow rate of the gases into the pre-heating chamber 2 will be kept constant by influencing the flow of recirculated neutral gas fumes into the combustion chamber, by means of the circuit $R_3$ which maintains at a constant level the pressure drop in the secondary cyclones by controlling the flow of recirculated fumes.

The coal input is set at a constant value, which is selected between 0.5 of the capacity and the nominal capacity. If the coal input is deliberately modified, or if the moisture in the coal is variable, the pre-heating temperature and the flow rate of the gases are automatically maintained at their desired value, as has just been explained. The operation of the apparatus is thus extremely flexible.

Additional observations can be made to demonstrate other advantages of the above described embodiments of the invention. The final dedusting of the waste gas fumes will be greatly facilitated. Indeed, the quality of fumes released into the atmosphere will be approximately equivalent to the volume of water vapour arising from the moisture in the coal, that is to say 9,000 m$^3$ N/h for a unit having a capacity of 80 tons per hour. In the conventional version of the pre-heater, the volume of fumes released into the atmosphere is 25,000 m$^3$ N/h. It should also be noted that the pre-heating fumes of the coal, from the moment when equilibrium is achieved, will contain essentially water vapour arising from the moisture of the coal. The waste gas fumes could therefore, if necessary, be condensed, which would avoid discharging them into the atmosphere. As for the dry-quenching fumes, they can still produce approximately 2 tons per hour of vapour by yielding their residual sensible heat in the boiler 46.

We claim:

1. In a process for at least one of drying and pre-heating coal to be coked, comprising the steps of:

(a) introducing said coal into a treatment chamber at a predetermined rate;

(b) introducing a heat-conveying gas selected from the group consisting of neutral and reducing heat-conveying gases into the treatment chamber;

(c) entraining and/or fluidizing the coal in said chamber by means of said gas so introduced;

(d) entraining said dried or preheated coal by said gas and separating coal from gases;

(e) recycling at least a part of said heat-conveying gas into the treatment chamber;

(f) collecting said part of recycled gas and introducing that gas so collected into a heat exchanger;

(g) introducing hot dry-quenching fumes produced by dry quenching of hot discharged coke into the said heat exchanger; and (h) transferring heat in the heat exchanger from the hot dry-quenching fumes to the heat-conveying gas, the improvement consisting of:

(1) utilizing as said heat-conveying gas a gas consisting essentially of water vapor maintained at a temperature of about 250° to about 650° C., and (2) recycling to the treatment chamber at least a portion of said heat conveying gas consisting essentially of water vapor.

2. A process according to claim 1, comprising introducing the coal in the treatment chamber and controlling the flow of quenching fumes into the heat exchanger in accordance with the amount of coal introduced into the treatment chamber.

3. A process according to claim 1, wherein all the hot dry-quenching fumes are used to generate heat by heat exchange.

4. A process according to claim 1, further including providing some of the heat necessary for at least one of the drying and preheating of the coal from a combustion chamber, which heat so provided is controlled in accordance with the temperature in the treatment chamber.

* * * * *